US011335266B2

(12) United States Patent
Meng et al.

(10) Patent No.: US 11,335,266 B2
(45) Date of Patent: May 17, 2022

(54) COMPENSATION METHOD FOR DISPLAY PANEL AND DISPLAY PANEL

(71) Applicants: HEFEI XINSHENG OPTOELECTRONICS TECHNOLOGY CO., LTD., Hefei (CN); BOE TECHNOLOGY GROUP CO., LTD., Beijing (CN)

(72) Inventors: Song Meng, Beijing (CN); Fei Yang, Beijing (CN); Chun Cao, Beijing (CN); Xiaolong Wei, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 100 days.

(21) Appl. No.: 16/765,846

(22) PCT Filed: Sep. 29, 2019

(86) PCT No.: PCT/CN2019/108882
§ 371 (c)(1),
(2) Date: May 20, 2020

(87) PCT Pub. No.: WO2020/119225
PCT Pub. Date: Jun. 18, 2020

(65) Prior Publication Data

US 2021/0225287 A1 Jul. 22, 2021

(30) Foreign Application Priority Data

Dec. 12, 2018 (CN) ..... 201811517896.5

(51) Int. Cl.
*G09G 3/00* (2006.01)
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2320/041* (2013.01)

(58) Field of Classification Search
None
See application file for complete search history.

(56) References Cited

U.S. PATENT DOCUMENTS

2009/0115795 A1 5/2009 Pae et al.
2010/0123649 A1 5/2010 Hamer et al.
(Continued)

FOREIGN PATENT DOCUMENTS

CN 101661713 A 3/2010
CN 102005195 A 4/2011
(Continued)

OTHER PUBLICATIONS

ISA China National Intellectual Property Administration, International Search Report Issued in Application No. PCT/CN2019/108882, dated Jan. 2, 2020, 17 pages. (Submitted with Partial Translation).
(Continued)

*Primary Examiner* — Michael A Faragalla
(74) *Attorney, Agent, or Firm* — McCoy Russell LLP

(57) ABSTRACT

A compensation method for a display panel and a display device are provided. The display panel includes a plurality of sub-pixels, and at least one of the plurality of sub-pixels includes a sensing capacitor. The method includes: obtaining a first voltage value and a second voltage value of the sensing capacitor, obtaining a temperature change amount of a sub-pixel corresponding to the sensing capacitor according
(Continued)

to the first voltage value and the second voltage value of the sensing capacitor, determining a value of a compensation parameter of the sub-pixel according to the temperature change amount of the sub-pixel and a preset correspondence between the temperature change amount of the sub-pixel and the compensation parameter; and performing a compensation on a driving voltage of the sub-pixel according to the value of the compensation parameter as determined.

20 Claims, 6 Drawing Sheets

(56) References Cited

U.S. PATENT DOCUMENTS

| | | | | |
|---|---|---|---|---|
| 2012/0105422 | A1 | 5/2012 | Zhao et al. | |
| 2012/0139955 | A1* | 6/2012 | Jaffari | G06F 30/23 345/690 |
| 2015/0154910 | A1* | 6/2015 | Okuno | G09G 3/3258 345/212 |
| 2016/0247450 | A1 | 8/2016 | Liu et al. | |
| 2018/0197468 | A1 | 7/2018 | Wu | |
| 2019/0130837 | A1 | 5/2019 | Chen | |
| 2020/0234644 | A1 | 7/2020 | Li et al. | |

FOREIGN PATENT DOCUMENTS

| | | | |
|---|---|---|---|
| CN | 102257555 | A | 11/2011 |
| CN | 102486912 | A | 6/2012 |
| CN | 104835469 | A | 8/2015 |
| CN | 106097969 | A | 11/2016 |
| CN | 106409231 | A | 2/2017 |
| CN | 106991969 | A | 7/2017 |
| CN | 107633810 | A | 1/2018 |
| CN | 107731160 | A | 2/2018 |
| CN | 109493805 | A | 3/2019 |
| JP | 2004102077 | A | 4/2004 |
| KR | 20140011577 | A | 1/2014 |

OTHER PUBLICATIONS

State Intellectual Property Office of the People's Republic of China, Office Action and Search Report Issued in Application No. 201811517896.5, dated Feb. 27, 2020, 14 pages. (Submitted with Partial Translation).

* cited by examiner

COMPENSATION METHOD FOR DISPLAY PANEL AND DISPLAY PANEL

CROSS-REFERENCE TO RELATED APPLICATIONS

The present application is a U.S. National Phase of International Application No. PCT/CN2019/108882 filed on Sep. 29, 2019. International Application No. PCT/CN2019/108882 claims priority to Chinese Patent Application No. 201811517896.5 filed on Dec. 12, 2018. The entire contents of each of the above-listed applications are hereby incorporated by reference for all purposes.

TECHNICAL FIELD

The present disclosure relates to the field of display technologies, in particular to a compensation method for a display panel and a display panel.

BACKGROUND AND SUMMARY

In an organic light-emitting diode (OLED) display panel, each sub-pixel is driven by a thin film transistor (TFT) to control a driving current flowing into an OLED, so as to control brightness of the OLED.

In a first aspect, a compensation method for a display panel is provided according to some embodiments of the present disclosure, the display panel includes a plurality of sub-pixels, at least one of the plurality of sub-pixels includes a sensing capacitor, and the method includes:

obtaining a first voltage value of the sensing capacitor, where the first voltage value is a voltage value of the sensing capacitor before the display panel displays an image;

obtaining a second voltage value of the sensing capacitor, where the second voltage value is a voltage value of the sensing capacitor when the display panel is in a display blank period;

obtaining a temperature change amount of a sub-pixel corresponding to the sensing capacitor according to the first voltage value and the second voltage value of the sensing capacitor;

determining a value of a compensation parameter of the sub-pixel according to the temperature change amount of the sub-pixel and a preset correspondence between the temperature change amount of the sub-pixel and the compensation parameter; and performing a compensation on a driving voltage of the sub-pixel according to the value of the compensation parameter as determined.

Optionally, the obtaining the first voltage value of the sensing capacitor includes:

charging the sensing capacitor of the sub-pixel with a first current value for a preset duration before the display panel displays the image; and calculating the first voltage value of the sensing capacitor according to the first current value and the preset duration, where the first current value is a current value corresponding to an initially compensated driving voltage of the sub-pixel, and the preset duration is a predetermined value.

Optionally, the obtaining the second voltage value of the sensing capacitor includes:

charging the sensing capacitor of the sub-pixel with a second current value for a preset duration in the display blank period between two adjacent frames of display images; and calculating the second voltage value of the sensing capacitor of the sub-pixel according to the second current value of the sub-pixel and the preset duration, where the second current value is a current value corresponding to a current driving voltage of the sub-pixel, and the preset duration is smaller than a refresh period of the display panel.

Optionally, the compensation parameter includes a carrier mobility and a threshold voltage of a driving thin film transistor (TFT).

Optionally, the determining the value of the compensation parameter of the sub-pixel according to the temperature change amount of the sub-pixel and the preset correspondence between the temperature change amount of the sub-pixel and the compensation parameter includes:

obtaining a correspondence between the temperature change amount and a compensation amount for the carrier mobility, and determining the compensation amount for the carrier mobility according to the obtained temperature change amount; and obtaining a correspondence between the temperature change amount and the threshold voltage of the driving TFT, and determining a compensation amount for the threshold voltage of the driving TFT according to the obtained temperature change amount.

Optionally, the performing the compensation on the driving voltage of the sub-pixel according to the value of the compensation parameter as determined includes:

compensating the driving voltage of the sub-pixel according to the compensation amount for the carrier mobility as determined and the compensation amount for the threshold voltage of the driving TFT as determined.

Optionally, subsequent to the obtaining the second voltage value of the sensing capacitor, the method further includes:

obtaining a difference value between the first voltage value and the second voltage value;

returning to a step of obtaining the second voltage value of the sensing capacitor, in a case that the difference value between the first voltage value and the second voltage value is smaller than a preset threshold; and performing steps of obtaining the temperature change amount of the sub-pixel corresponding to the sensing capacitor according to the first voltage value and the second voltage value of the sensing capacitor, and determining the value of the compensation parameter of the sub-pixel according to the temperature change amount of the sub-pixel and the preset correspondence between the temperature change amount of the sub-pixel and the compensation parameter, in a case that the difference value between the first voltage value and the second voltage value is not smaller than the preset threshold, and returning to the step of obtaining the second voltage value of the sensing capacitor after performing the compensation on the driving voltage of the sub-pixel according to the value of the compensation parameter as determined.

Optionally, the first current value is calculated according to the following formula:

$$I_1 = \frac{1}{2} K_1 C_{ox} \frac{W}{L} (V_{gs1} - V_{th1})^2$$

where $I_1$ is the first current value, $C_{ox}$ is a gate oxide capacitance of the driving TFT; W/L is a width-to-length ratio of the driving TFT; $V_{gs1}$ is the initially compensated driving voltage of the sub-pixel; $K_1$ is an initial value of a carrier mobility of the driving TFT, and $V_{th1}$ is an initial value of a threshold voltage of the driving TFT.

Optionally, the first voltage value is calculated according to the following formula:

$$V_1 = \frac{1}{C}\int_0^T I_1 dt$$

where $V_1$ is the first voltage value, C is a capacitance value of the sensing capacitor, $I_1$ is the first current value, and T is the preset duration.

Optionally, the second current value is calculated according to the following formula:

$$I_2 = \frac{1}{2}K_2 C_{ox}\frac{W}{L}(V_{gs2} - V_{th2})^2$$

where $I_2$ is the second current value, $C_{ox}$ is a gate oxide capacitance of the driving TFT; W/L is a width-to-length ratio of the driving TFT; $V_{gs2}$ is the current driving voltage of the sub-pixel; $K_2$ is a current carrier mobility of the driving TFT, and $V_{th2}$ is a current threshold voltage of the driving TFT.

Optionally, the second voltage value is calculated according to the following formula:

$$V_2 = \frac{1}{C}\int_0^T I_2 dt$$

where $V_2$ is the second voltage value, C is a capacitance value of the sensing capacitor, $I_2$ is the second current value, and T is the preset duration.

In a second aspect, a display panel is provided according to some embodiments of the present disclosure, which includes a plurality of sub-pixels. At least one of the plurality of sub-pixels includes a sensing capacitor, The display panel includes:

a first obtaining circuit, configured to obtain a first voltage value of the sensing capacitor, where the first voltage value is a voltage value of the sensing capacitor before the display panel displays an image;

a second obtaining circuit, configured to obtain a second voltage value of the sensing capacitor, where the second voltage value is a voltage value of the sensing capacitor when the display panel is in a display blank period;

a temperature change amount obtaining circuit, configured to obtain a temperature change amount of a sub-pixel corresponding to the sensing capacitor according to the first voltage value and the second voltage value of the sensing capacitor;

a compensation parameter value determining circuit, configured to determine a value of a compensation parameter of the sub-pixel according to the temperature change amount of the sub-pixel and a preset correspondence between the temperature change amount of the sub-pixel and the compensation parameter; and a compensation circuit, configured to perform a compensation on a driving voltage of the sub-pixel according to the value of the compensation parameter as determined.

Optionally, the first obtaining circuit is configured to charge the sensing capacitor of the sub-pixel with a first current value for a preset duration before the display panel displays the image; and calculate the first voltage value of the sensing capacitor according to the first current value and the preset duration, where the first current value is a current value corresponding to an initially compensated driving voltage of the sub-pixel, and the preset duration is a predetermined value.

Optionally, the second obtaining circuit is configured to charge the sensing capacitor of the sub-pixel with a second current value for a preset duration in the display blank period between two adjacent frames of display images; and calculate the second voltage value of the sensing capacitor of the sub-pixel according to the second current value of the sub-pixel and the preset duration, the preset duration being smaller than a refresh period of the display panel.

Optionally, the compensation parameter includes a carrier mobility and a threshold voltage of a driving TFT, and the compensation parameter value determining circuit includes a carrier mobility determining sub-circuit and a threshold voltage determining sub-circuit, the carrier mobility determining sub-circuit is configured to obtain a correspondence between the temperature change amount and a compensation amount for the carrier mobility, and determine the compensation amount for the carrier mobility according to the obtained temperature change amount; and the threshold voltage determining sub-circuit is configured to obtain a correspondence between the temperature change amount and the threshold voltage of the driving TFT, and determine a compensation amount for the threshold voltage of the driving TFT according to the obtained temperature change amount.

Optionally, the compensation circuit is configured to perform the compensation on the driving voltage of the sub-pixel according to the compensation amount for the carrier mobility as determined and the compensation amount for the threshold voltage of the driving TFT as determined.

Optionally, the display panel further includes a third obtaining circuit, and the third obtaining circuit is configured to obtain a difference value between the first voltage value and the second voltage value;

in a case that the difference value between the first voltage value and the second voltage value is smaller than a preset threshold, the second obtaining circuit obtains the second voltage value of the sensing capacitor; and in a case that the difference value between the first voltage value and the second voltage value is not smaller than the preset threshold, the temperature change amount obtaining circuit obtains the temperature change amount of the sub-pixel corresponding to the sensing capacitor according to the first voltage value and the second voltage value of the sensing capacitor, the compensation parameter value determining circuit determines the value of the compensation parameter of the sub-pixel according to the temperature change amount of the sub-pixel and the preset correspondence between the temperature change amount of the sub-pixel and the compensation parameter, and the second obtaining circuit obtains the second voltage value of the sensing capacitor after the compensation circuit performs the compensation on the driving voltage of the sub-pixel according to the value of the compensation parameter as determined.

In a third aspect, a display device is further provided according to some embodiments of the present disclosure, including the display panel described above.

BRIEF DESCRIPTION OF THE DRAWINGS

In order to illustrate the technical solutions of some embodiments of the present disclosure in a clearer manner, the drawings desired for some embodiments of the present disclosure will be described hereinafter briefly. Obviously, the drawings in the following description merely relate to some embodiments of the present disclosure, and based on these drawings, a person skilled in the art may obtain other drawings without creative efforts.

DETAILED DESCRIPTION

The technical solutions in some embodiments of the present disclosure will be described hereinafter clearly and completely with reference to the drawings in some embodiments of the present disclosure. Obviously, the described embodiments are merely a part of, rather than all of, the embodiments of the present disclosure. All the other embodiments obtained by persons of ordinary skill in the art based on the embodiments of the present disclosure and without paying creative efforts shall fall within the protection scope of the present disclosure.

When an OLED emits light, electrical characteristics of driving TFTs of sub-pixels may not be ensured to be completely the same due to factors such as process conditions. When driving voltages of various sub-pixels are the same, driving currents corresponding to the sub-pixels may be different, which may cause brightness differences between the sub-pixels.

A characteristic parameter of the driving TFT of each pixel are detected to generate a corrected driving voltage in an external compensation technique in the related technology, thereby addressing the issue of the uneven brightness caused by the different electrical characteristics of the driving TFTs. However, a display panel itself may heat up during usage, which causes some electrical parameters to change, affects a compensation result and affects a display effect.

In view of the above technical problems, a compensation method for a display panel is provided according to some embodiments of the present disclosure.

The display panel includes a plurality of sub-pixels, each sub-pixel includes a sensing capacitor coupled to a sensing line of the sub-pixel.

Figure 1:
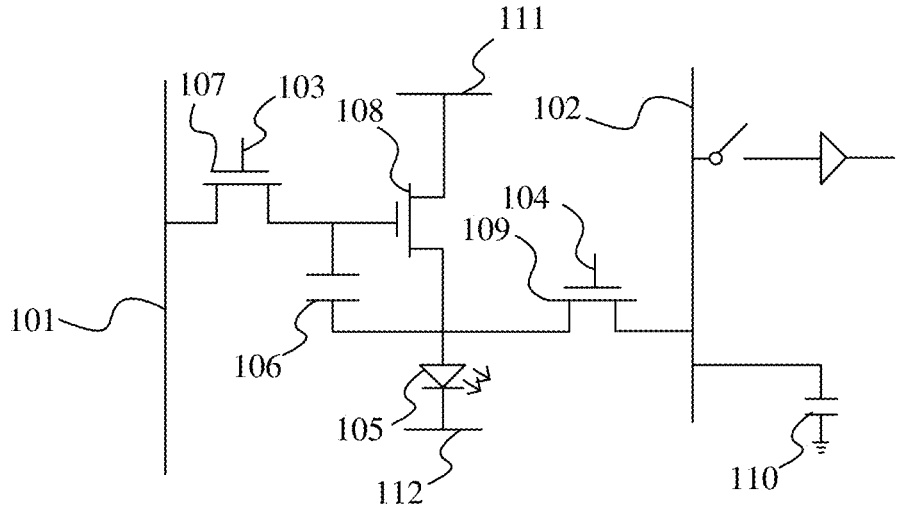
FIG. 1 is a circuit diagram of a sub-pixel in some embodiments of the present disclosure.

As shown in FIG. 1, FIG. 1 is a diagram of a 3T1C external compensation pixel circuit, 3T refers to that the number of TFT switches is 3, and 1C refers to that the number of capacitors is 1.

The 3T1C external compensation pixel circuit as shown in FIG. 1 includes at least a data line DL 101, a sensing line SL 102, two gate driving lines, which are a scanning line 103 and a sensing line 104, an organic light emitting diode OLED 105, a storage capacitor Cst 106, a switching TFT (i.e., a scanning TFT) 107, a driving TFT 108, a sensing TFT 109, a sensing capacitor (Csense) 110 coupled to the sensing line. A set of electroluminescence (EL) signals, i.e., an OLED anode voltage ELVDD 111 and an OLED cathode voltage ELVSS 112, are required to be provided.

Obviously, in an implementation, the sub-pixel may also be a sub-pixel of other structures including but not limited to 4T1C and 5T1C, which are not further limited herein.

Figure 2:
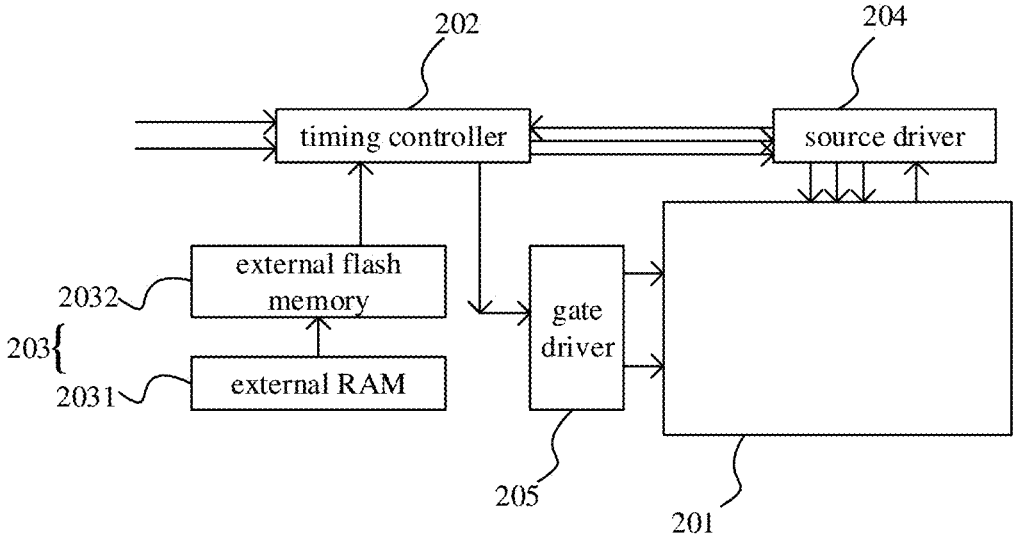
FIG. 2 is a schematic structural diagram of a display device in some embodiments of the present disclosure

As shown in FIG. 2, a display device includes a display panel 201, a timing controller 202, an external memory 203, a source driver 204, and a gate driver 205. The external memory 203 may further include an external flash memory 2031 and an external RAM 2032 (such as a Double Data Rate Synchronous Dynamic Random Access Memory, DDRSDRAM).

Two arrows in the left of FIG. 2 pointing to the timing controller 202 respectively denote externally inputted video data and timing control signals HS/VS/DE, which are received by the timing controller 202. When the video data and the HS/VS/DE are received, the timing controller 202 simultaneously reads compensation data stored in the external memory 203. The timing controller 202 also receives pixel internal sensing data (SData) outputted by the source driver 204; after performing conversion, calculation, compensation and other algorithms, the timing controller 202 generates display data and a source control signal SCS to output to the source driver 204 during an operation stage of an OLED display device; and the timing controller 202 further generates a gate control signal GCS to output to the gate driver 205, which finally controls an normal output of an image.

During an blank stage of the OLED display device, the timing controller 202 generates display data and source control signal SCS to output to the source driver 204; the timing controller 202 generates the gate control signal GCS to output to the gate driver 205, and the sensing data SData is obtained under the cooperation of the gate driver 205 and the source driver 204.

Figure 3:
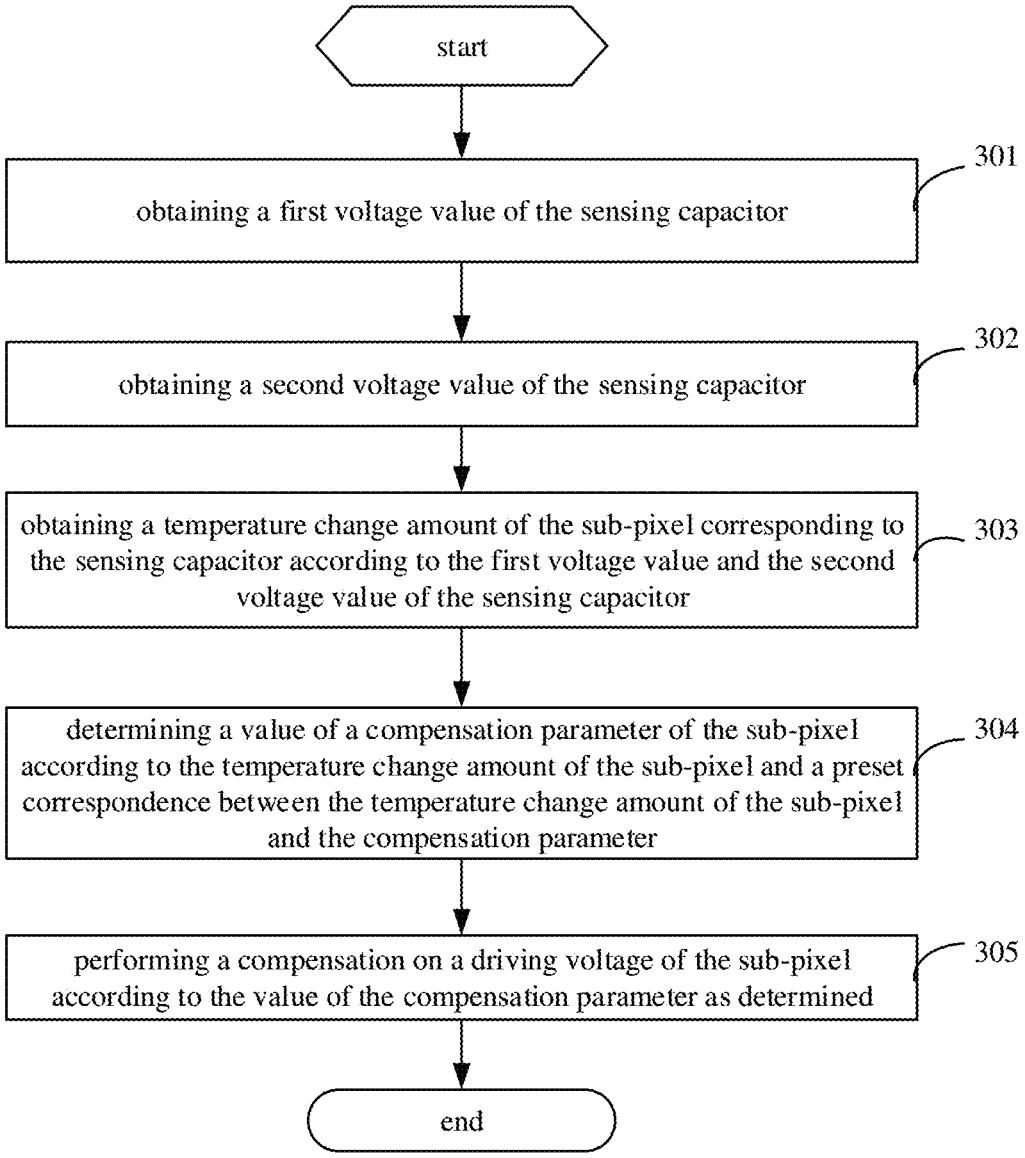
FIG. 3 is a flowchart of a compensation method for a display panel in some embodiments of the present disclosure.

As shown in FIG. 3, in an embodiment, the compensation method for the display panel 201 includes the following steps.

Step 301 includes: obtaining a first voltage value of the sensing capacitor 110, where the first voltage value is a voltage value of the sensing capacitor 110 before the display panel 201 displays an image.

In some embodiments of the present disclosure, for the display panels 201 having a same model number, brightnesses of pixels of a same color is designed to be the same, so $I_{OLED}$ of the pixels of the same color should also be identical, and theoretically, first voltage values corresponding to sensing capacitors of sub-pixels of a same color are also identical. Therefore, before the display panel 201 displays the image, a voltage value of the sensing capacitor 110 of a sub-pixel may be measured, and the measured voltage value may be used as the first voltage value V1 of the sub-pixels of the color in the display panels 201 having the same model number. During an implementation, the first voltage value may be stored in a storage device, such as the external memory 203, and the first voltage value may be invoked when needed.

However, it should be appreciated that due to an influence of factors such as manufacturing processes and procedures, there may be a certain difference among various electrical parameters of the display panels 201, and thus there may be also a certain difference among the first voltage values corresponding to the display panels having the same model number. Therefore, in some embodiments of the present disclosure, the first voltage value is calculated by collecting relevant parameters.

Specifically, in an optional and specific embodiment, the step 301 specifically includes: charging the sensing capacitor 110 of the sub-pixel with a first current value for a preset duration before the display panel 201 displays the image, and calculating the first voltage value of the sensing capacitor 110 according to the first current value and the preset duration, where the first current value is a current value corresponding to an initially compensated driving voltage value of the sub-pixel.

For the display panel 201 without an initial compensation, the voltage value refers to an initial voltage value of the sensing capacitor of the sub-pixel in the display panel 201. For the display panel with the initial compensation, the voltage value is a voltage value determined after the initial compensation. In general, most display panels have the initial compensation.

The initial compensation in the embodiments refers to performing a compensation on the driving voltage of the sub-pixel according to a probable compensation method in the related technology. An initial compensation method in the related technology is that, during operation of the display panel 201, preset compensation data is read from the external memory 203 to perform the initial compensation on the driving voltage of the sub-pixel, which may refer to the method for compensating the driving voltage in the related technology for details, and is not further limited and described herein.

In some embodiments of the present disclosure, the initial compensation is to detect the driving TFT characteristic parameters of each pixel to generate a compensated driving voltage. Current values $I_{OLED}$ of the sub-pixels are identical under the driving of the compensated driving voltage, so, theoretically, brightnesses values of the pixels of the same color after the initial compensation are also identical.

Specifically, the initially compensated driving voltage value of the sub-pixel may be obtained before the display panel 201 displays the image. The sensing capacitor 110 of each sub-pixel is charged with the first current value corresponding to the initially compensated driving voltage value for the preset duration T.

$$I_1 = \frac{1}{2}K_1 C_{ox}\frac{W}{L}(V_{gs1} - V_{th1})^2 \tag{1}$$

Further, $I_1$ may be calculated and obtained according to the above formula (1). $C_{ox}$ is a gate oxide capacitance of the driving TFT, and is a fixed value. W/L is a width-to-length ratio of the driving TFT, and is a fixed value determined by a transistor structure. $V_{gs1}$ is the initially compensated driving voltage of the sub-pixel. $K_1$ is an initial value of a carrier mobility of the driving TFT, and $V_{th1}$ is an initial value of a threshold voltage of the driving TFT. K and $V_{th}$ are parameters that need to be compensated, and the initial values of K and $V_{th}$ are determined according to the compensation method in the related technology.

After the $I_{OLED}$ is obtained through calculation, the first voltage value may be further calculated according to the above charging duration T (i.e., the preset duration).

$$V_1 = \frac{1}{C}\int_0^T I_1 dt \tag{2}$$

In the above formula (2), C is a capacitance value of the sensing capacitor 110, $V_1$ is the first voltage value, and $I_1$ is the first current value. The first voltage value of the sensing capacitor 110 may be calculated by substituting the charging duration T and the current value $I_1$ into the above formula (2).

The first voltage value calculated in the above process better conforms to a practical situation of the display panel 201 as compared with a theoretical value, which facilitates improving the compensation accuracy.

Step 302 includes: obtaining a second voltage value of the sensing capacitor 110.

The second voltage value is a voltage value of the sensing capacitor 110 when the display panel 201 is in a display blank period.

When displaying the image, the display panel 201 continuously refreshes and displays multiple frames of images to form a static or dynamic image observed by a user. The second voltage value V2 is a voltage value measured in a blank period between two adjacent frames of display images (or between two adjacent active periods, etc.).

In a specific implementation, the second voltage value of the sensing capacitor 110 may be directly measured by a sensor or the like, but a measurement frequency is relatively high, so it is relatively difficult to test the second voltage value of the sensing capacitor 110 by using the sensor directly.

In an optional and specific embodiment, the second voltage value of the sensing capacitor 110 is obtained in the following manner.

The sensing capacitor 110 of the sub-pixel is charged with a second current value for the preset duration in the display blank period between two adjacent frames of display images, and the second voltage value of the sensing capacitor 110 of the sub-pixel is calculated according to the second current value of the sub-pixel and the preset duration, where the second current value is a current value corresponding to a current driving voltage of the sub-pixel, and the preset duration is smaller than a refresh period of the display panel 201.

Specifically, the second current value may be calculated according to the following formula.

$$I_2 = \frac{1}{2}K_2 C_{ox}\frac{W}{L}(V_{gs2} - V_{th2})^2 \tag{3}$$

$I_2$ is the second current value, $C_{ox}$ is the gate oxide capacitance of the driving TFT, and is the fixed value. W/L is the width-to-length ratio of the driving TFT, and is the fixed value determined by the transistor structure. $K_{gs2}$ is the current driving voltage of the sub-pixel. $K_2$ is a current value of the carrier mobility of the driving TFT, and $V_{th2}$ is a current value of the threshold voltage of the driving TFT.

Specifically, the second voltage value may be calculated according to the following formula.

$$V_2 = \frac{1}{C}\int_0^T I_2 dt \tag{4}$$

$V_2$ is the second voltage value, C is the capacitance value of the sensing capacitor, $I_2$ is the second current value, and T is the preset duration.

A compensation voltage in a compensating method in the related technology is generally a fixed value determined according to compensation data stored in the external memory. It may be appreciated that, for a certain display image, the compensation data of the sub-pixel is a fixed value. In the embodiments, even for the certain display image, the compensation data of the sub-pixel may change to some extent, and the driving voltage may also change accordingly. In the embodiments, the current driving voltage refers to a latest compensated driving voltage, the current carrier mobility refers to a latest compensated carrier mobility, and the current threshold voltage refers to a threshold voltage that is most currently compensated.

When obtaining the first voltage value and the second voltage value, the charging durations T should be identical, and in order to avoid an interference with a normal display, the charging duration T should be smaller than the refresh period of the display panel 201, and the charging process should be performed in the blank period.

Step 303 includes: obtaining a temperature change amount of the sub-pixel corresponding to the sensing capacitor 110 according to the first voltage value and the second voltage value of the sensing capacitor 110.

The first voltage value in the embodiment corresponds to a state where the display panel 201 has not yet displayed any content. At this time, the brightness of the display panel 201 is the brightness after the initial compensation, and may also be understood as reference brightness or standard brightness. Thus, when a voltage value of the sensing capacitor 110 is the first voltage value, the brightness of the display panel 201 is also the standard brightness.

When a temperature of the display panel 201 changes, the related electrical parameters may also change, which may cause a certain deviation between a practical voltage value of the sensing capacitor 110 (that is, the obtained second voltage value) and the first voltage value.

During an implementation, a relationship between the temperature change amount of the sensing capacitor 110 and a voltage change amount may be tested in advance and stored, for example, in the external memory 203 described above. During the operation of the display panel 201, a voltage change amount may be obtained according to a difference between the first voltage value and the second voltage value, after the first voltage value and the second voltage value are measured, then a temperature change amount corresponding to the difference between the first voltage value and the second voltage value may be determined by invoking the relationship between the temperature change amount of the sensing capacitor 110 and the voltage change amount, and the temperature change amount is used as a temperature change amount of the display panel 201.

The relationship may be a preset corresponding table, and then the temperature change amount is determined by retrieving data in the corresponding table. The relationship may also be realized by using a preset algorithm. The temperature change amount is calculated or estimated by substituting the measured second voltage value into a relevant calculation formula.

Step 304 includes: determining a value of a compensation parameter of the sub-pixel according to the temperature change amount of the sub-pixel and a preset correspondence between the temperature change amount of the sub-pixel and the compensation parameter.

After the temperature change amount of the sub-pixel is determined, the value of the compensation parameter corresponding to the temperature change amount may be determined according to the temperature change amount.

Figure 4:
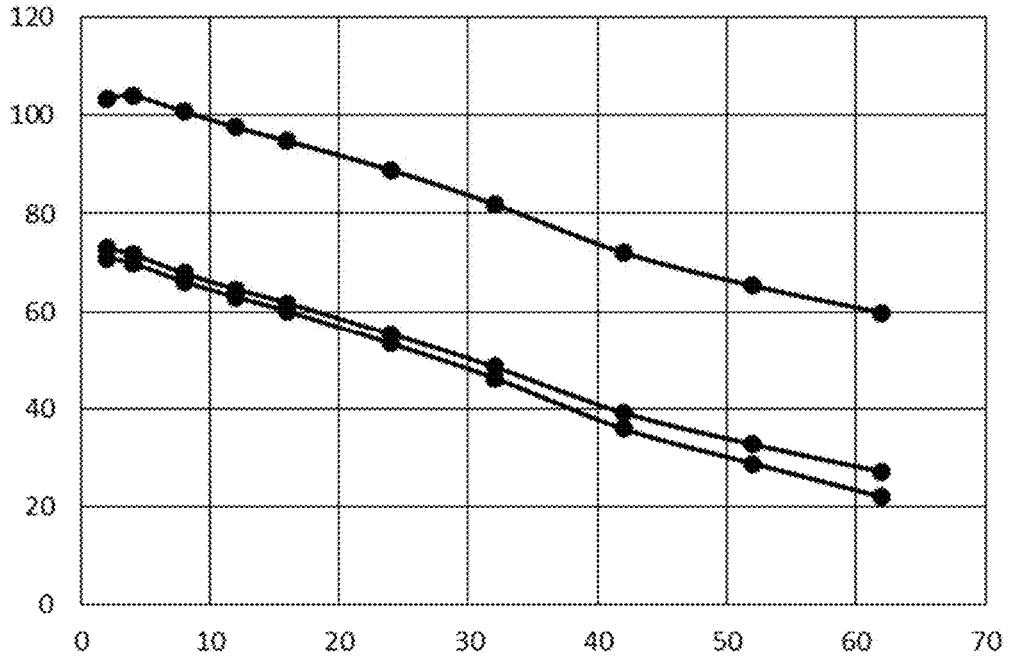
FIG. 4 is a diagram of a relationship between a carrier mobility and a temperature in some embodiments of the present disclosure.
Figure 5:
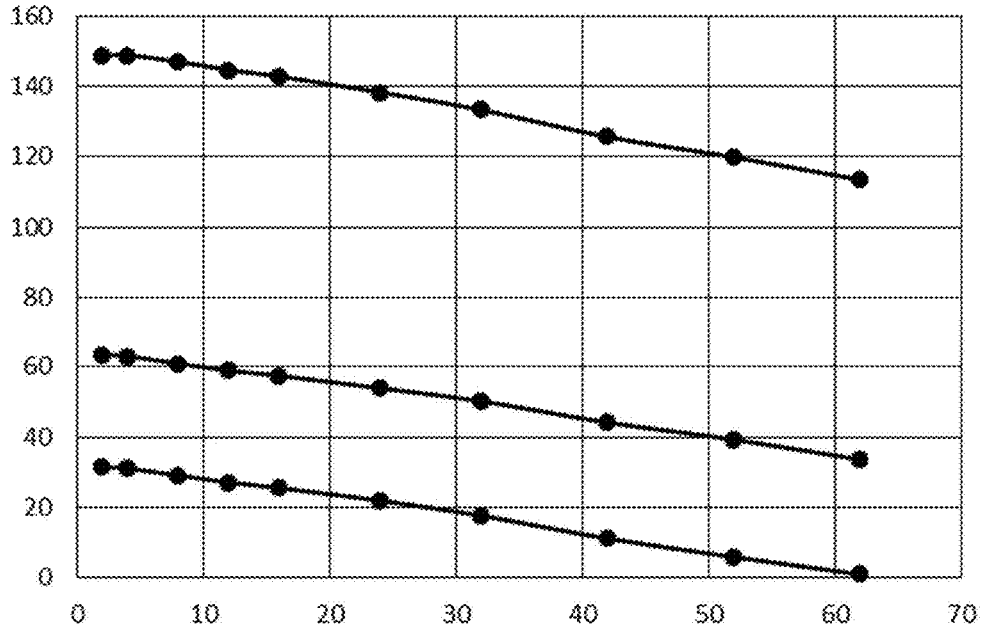
FIG. 5 is a diagram of a relationship between a threshold voltage of a driving TFT and a temperature in some embodiments of the present disclosure.

Please referring to FIG. 4 and FIG. 5, FIG. 4 is a diagram of a relationship between a carrier mobility K and a temperature of the display panel, where a horizontal axis represents the temperature in Celsius degree (° C.), and a vertical axis represents the carrier mobility K in square centimeters per volt-second ($cm^2/Vs$). Relationship curves of the carrier mobility K of a blue (B) pixel, a green (G) pixel and a red (R) pixel and the temperature are showed from top to bottom of FIG. 4.

FIG. 5 is a diagram of a relationship between a threshold voltage $V_{th}$ of the driving TFT and the temperature of the display panel, where a horizontal axis represents the temperature in Celsius degree (° C.), and a vertical axis represents the threshold voltage $V_{th}$ of the driving TFT in millivolt (mV). Relationship curves of the threshold voltage $V_{th}$ of the driving TFT of the blue (B) pixel, the green (G) pixel and the red (R) pixel and the temperature are showed from top to bottom of FIG. 5.

It can be seen from FIG. 4 and FIG. 5 that the carrier mobility K and the threshold voltage $V_{th}$ of the driving TFT vary greatly with the temperature. It may be known from the above formula (1) that the carrier mobility K and the threshold voltage $V_{th}$ of the driving TFT have a greater influence on the current flowing through the sub-pixel. Therefore, in a specific embodiment, the compensation parameters include the carrier mobility K and the threshold voltage $V_{th}$ of the driving TFT.

The step 304 specifically includes obtaining a correspondence between the temperature change amount and a compensation amount for the carrier mobility, and determining the compensation amount for the carrier mobility according to the obtained temperature change amount; and obtaining a correspondence between the temperature change amount and a compensation amount for the threshold voltage of the driving TFT, and determining the compensation amount for the threshold voltage of the driving TFT according to the obtained temperature change amount.

The correspondence between the temperature change amount and the compensation amount for the carrier mobility, and the correspondence between the temperature change amount and a compensation amount for the threshold voltage of the driving TFT may be measured through experiments and stored in advance, for example, in the external memory 203. The compensation amount for the carrier mobility K and the compensation amount for the threshold voltage of the driving TFT may be obtained by calling the corresponding correspondence while in use.

For example, in an $n^{th}$ compensation, the carrier mobility is K(n), the threshold voltage of the driving TFT is Vth(n), and the compensation amount for the carrier mobility determined according to the temperature change amount is LUT (ΔT, ΔV, ΔK), and the compensation amount for the threshold voltage of the driving TFT determined according to the temperature change amount is LUT(ΔT, ΔV, ΔVth).

ΔT denotes the temperature change amount, ΔV denotes the difference value between the first voltage value and the second voltage value, LUT(ΔT, ΔV, ΔK) denotes the compensation amount ΔK for compensating the carrier mobility determined according to ΔT, ΔV and the preset correspondence, similarly, LUT(ΔT, ΔV, ΔVth) denotes the compensation amount ΔVth for compensating the threshold voltage of the driving TFT.

$$K(n+1)=K(n)+\mathrm{LUT}(\Delta T,\Delta V,\Delta K) \quad (3)$$

$$Vth(n+1)=Vth(n)+\mathrm{LUT}(\Delta T,\Delta V,\Delta Vth) \quad (4)$$

From the above formulas (3) and (4), a carrier mobility K(n+1) and a threshold voltage $Vth^{(n+1)}$ of the driving TFT in an $(n+1)^{th}$ compensation may be calculated and obtained.

Step 305 includes: performing a compensation on a driving voltage of the sub-pixel according to the value of the compensation parameter as determined.

After determining the compensation amount K for the carrier mobility and the compensation amount for the threshold voltage of the driving TFT, the driving voltage may be compensated.

In some embodiments of the present disclosure, the first voltage value and the second voltage value are measured, and the temperature change amount of the display panel is determined according to the first voltage value and the second voltage value, the value of the compensation parameter of the display panel is determined according to the temperature change amount, and when the compensation is performed on the driving voltage of the display panel, the used value of the compensation parameter is more consistent with a practical state of the display panel, which makes the compensation result more accurate and is conducive to improving the display effect.

During the compensation, a data voltage of the sub-pixel is adjusted from Data1(K(n), Vth(n), GL) to Data2(K(n+1), Vth(n+1), GL), so that the compensation on the driving voltage of the sub-pixel can be realized. GL denotes a grayscale of the sub-pixel; Data1(K(n), Vth(n), GL) refers to a value determined by K(n), Vth(n) and GL.

When the compensation is performed on the driving voltage of the sub-pixel, the driving voltage may be brought to a target value through one adjustment.

In an optional and specific embodiment, the driving voltage may also be adjusted for multiple times to the target value, for example, when a difference between the current driving voltage and a target driving voltage is 100 mV, 10 mV may be adjusted each time, and the driving voltage reaches the target driving voltage through 10 adjustments, so that a change curve of the display brightness of the display panel 201 is smooth, and a user experience may not adversely affected due to a fast change speed of the brightness change.

Further, in an embodiment, when the obtained second voltage value is equal to the first voltage value, it means that the brightness of the display panel 201 is equal to the standard brightness, and no additional compensation for the driving voltage is required.

It should be appreciated that, in a practical operation, it may be difficult for the second voltage value to be completely equal to the first voltage value.

Thus, subsequent to the step 302, a difference value between the first voltage value and the second voltage value is obtained, in a case that the difference value between the first voltage value and the second voltage value is smaller than a preset threshold, it means that the temperature change amount of the sub-pixel is small, and it may be considered that the brightness of the display panel 201 is basically equal to the standard brightness, and then a next compensation may be performed on the sub-pixel by using the current compensated driving voltage of the sub-pixel.

The preset threshold may be set to be various values such as 1 mV, 2 mV, 10 mV. Obviously, the smaller the preset threshold is set to be, the better a compensation effect is, while the larger the preset threshold is set to be, the smaller a system load will be. During an implementation, a value that weighs the display effect and the system load according to practical applications may be chosen, for example, 1 mV.

After the compensation, the step 302 is returned to and a new second driving voltage is obtained.

Subsequent to the step 302, in a case that the difference value between the first voltage value and the second voltage value is not smaller than a preset threshold, it means that the temperature change amount of the sub-pixel is large, and the driving voltage of the sub-pixel is required to be updated.

Specifically, the subsequent step 303 to step 305 may be performed to update the driving voltage of the sub-pixel. After the driving voltage of the sub-pixel is updated, the step 302 is returned to and a new second driving voltage is obtained.

Figure 6:
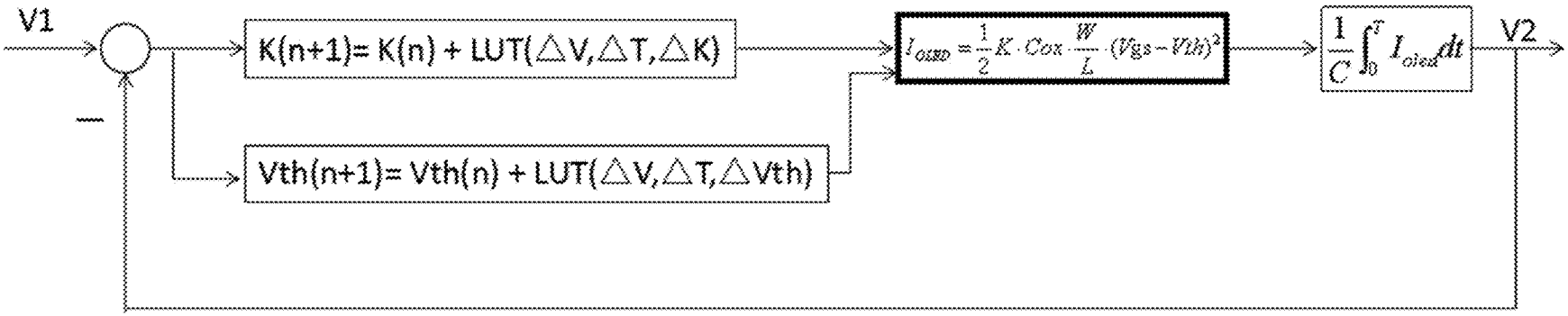
FIG. 6 is a schematic diagram of an algorithm of a compensation process in some embodiments of the present disclosure.

As shown in FIG. 6, in this way, by continuously obtaining the second voltage value V2 and comparing it with the first voltage value V1, then estimating the temperature change amount, and further determining the value of the compensation parameter, a dynamic compensation can be performed on the driving voltage of the sub-pixel to continuously adjust the brightness of the display panel 201 according to the temperature change, such that the compensation result is more accurate, and the display effect of the display panel 201 is improved.

For example, the first voltage V1 may be used as the target value. During a blank period between frames displayed in real time (or between two adjacent active periods), a voltage Data (K(n),Vth(n),GL)) is applied to the data line DL of the sub-pixel, n denotes the $n^{th}$ compensation, the charging duration is T, the second voltage V2 may be sampled and obtained from the sensing capacitor Csense after the charging is finished.

In a case that the difference value between the first voltage value V1 and the second voltage value V2 is smaller than the preset threshold, for example, V2=V1, it means that the carrier mobility K(n) of the driving TFT and the threshold voltage Vth(n) are not affected by the temperature of the display panel.

In a case that the difference value between the first voltage value V1 and the second voltage value V2 is not smaller than the preset threshold, it means that there is a deviation in the carrier mobility K(n) of the driving TFT and the threshold voltage Vth(n) due to the influence of the temperature of the display panel. In this case, a temperature change amount ΔT may be calculated according to the first voltage value V1 and the second voltage value V2, and the compensation amount for the carrier mobility is determined as LUT(ΔT, ΔV, ΔK) according to the temperature change amount ΔT, and the compensation amount for the threshold voltage of the driving TFT is LUT(ΔT, ΔV, ΔVth), and K(n+1) and Vth(n+1) are updated. When a next compensation is performed, the updated K(n+1) and Vth(n+1) are used to generate a new second voltage value V2, and the compensation is finished until V2=V 1. Thus, the brightness of the display panel 201 may be continuously adjusted as the temperature changes, thereby making the compensation result more accurate and improving the display effect of the display panel 201.

Figure 7A:
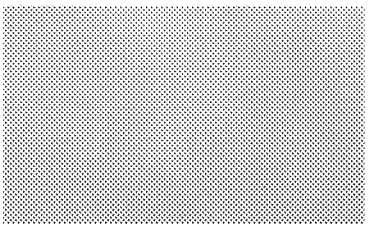
FIG. 7 is a comparison diagram of a display effect of a display panel in some embodiments of the present disclosure and a display effect of a display panel in the related technology.
Figure 7B:
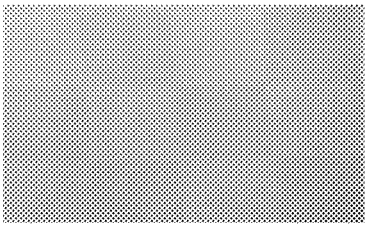

FIG. 7 is a comparison diagram between a display effect by using the compensation method in the embodiments of the present disclosure and a display effect by using the compensation method in the related technology when image sticking are the same. When a screen of the display device switches to display a next image following a display of a same image for a while, part of the original image may remain in the next image. The phenomenon is referred to as image sticking.

FIG. 7(*a*) is a diagram of the display effect after using the compensation method in the related technology, FIG. 7(*b*) is a diagram of the display effect after using the compensation method in the embodiments of the present disclosure. It can be seen that the compensation result is more accurate, and the display effect is better in the compensation method in the embodiments of the present disclosure.

A display panel 700 is further provided in some embodiments of the present disclosure.

Figure 8:
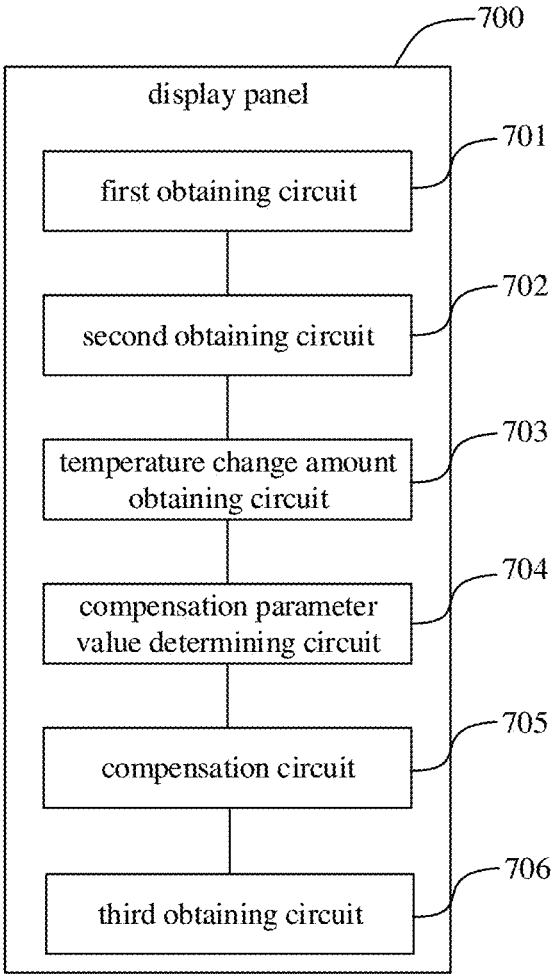
FIG. 8 is a structural diagram of a display panel in some embodiments of the present disclosure.

The display panel 700 includes a plurality of sub-pixels, at least one of the plurality of sub-pixels includes a sensing capacitor 110, as shown in FIG. 8, the display panel 700 further includes: a first obtaining circuit 701 configured to obtain a first voltage value of the sensing capacitor 110, the first voltage value is a voltage value of the sensing capacitor 110 before the display panel 700 displays an image; a second obtaining circuit 702 configured to obtain a second voltage value of the sensing capacitor 110, the second voltage value is a voltage value of the sensing capacitor 110 when the display panel 700 is in a display blank period; a temperature change amount obtaining circuit 703 configured to obtain a temperature change amount of a sub-pixel corresponding to the sensing capacitor 110 according to the first voltage value and the second voltage value of the sensing capacitor 110; a compensation parameter value determining circuit 704 configured to determine a value of a compensation parameter of the sub-pixel according to the temperature change amount of the sub-pixel and a preset correspondence between the temperature change amount of the sub-pixel and the compensation parameter; and a compensation circuit 705 configured to perform a compensation on a driving voltage of the sub-pixel according to the value of the compensation parameter as determined.

In some embodiments of the present disclosure, the first voltage value and the second voltage value are measured, and the temperature change amount of the display panel 700 is determined according to the first voltage value and the second voltage value, the value of the compensation parameter of the display panel 700 is determined according to the temperature change amount, when the compensation is performed on the driving voltage of the display panel 700, the used value of the compensation parameter better matches a practical state of the display panel 700, which makes the compensation result more accurate and facilitates improving the display effect.

Optionally, the first obtaining circuit 701 is configured to charge the sensing capacitor 110 of the sub-pixel with a first current value for a preset duration before the display panel 700 displays the image, and calculate the first voltage value of the sensing capacitor 110 according to the first current value and the preset duration, the first current value is a current value corresponding to an initially compensated driving voltage value of the sub-pixel.

Optionally, the second obtaining circuit 702 is configured to charge the sensing capacitor 110 of the sub-pixel with a second current value for the preset duration in the display blank period between two adjacent frames of display images, and calculate the second voltage value of the sensing capacitor 110 of the sub-pixel according to the second current value of the sub-pixel and the preset duration, the second current value is a current value corresponding to a current driving voltage of the sub-pixel, and the preset duration is smaller than a refresh period of the display panel 700.

Optionally, the compensation parameter includes a carrier mobility and a threshold voltage of a driving TFT, and the compensation parameter value determining circuit 704 includes a carrier mobility determining sub-circuit and a threshold voltage determining sub-circuit, the carrier mobility determining sub-circuit is configured to obtain a correspondence between the temperature change amount and a compensation amount for the carrier mobility, and determine the compensation amount for the carrier mobility according to the obtained temperature change amount; and the threshold voltage determining sub-circuit is configured to obtain a correspondence between the temperature change amount and a compensation amount for the threshold voltage of the driving TFT, and determine the compensation amount for the threshold voltage of the driving TFT according to the obtained temperature change amount.

Optionally, the compensation circuit 705 is configured to perform the compensation on the driving voltage of the sub-pixel according to the compensation amount for the carrier mobility as determined and the compensation amount for the threshold voltage of the driving TFT as determined.

Optionally, the display panel further includes a third obtaining circuit 706, the third obtaining circuit 706 is configured to obtain a difference value between the first voltage value and the second voltage value; when the difference value between the first voltage value and the second voltage value is smaller than a preset threshold, the second obtaining circuit 702 obtains the second voltage value of the sensing capacitor 110; when the difference value between the first voltage value and the second voltage value is not smaller than the preset threshold, the temperature change amount obtaining circuit 703 obtains the temperature change amount of the sub-pixel corresponding to the sensing capacitor 110 according to the first voltage value and the second voltage value of the sensing capacitor 110, and the compensation parameter value determining circuit 704 determines the value of the compensation parameter of the sub-pixel according to the temperature change amount of the sub-pixel and the preset correspondence between the temperature change amount of the sub-pixel and the compensation parameter, and the second obtaining circuit 702 obtains the second voltage value of the sensing capacitor 110 after the compensation circuit 705 performs the compensation on the driving voltage of the sub-pixel according to the value of the compensation parameter as determined.

Figure 9:
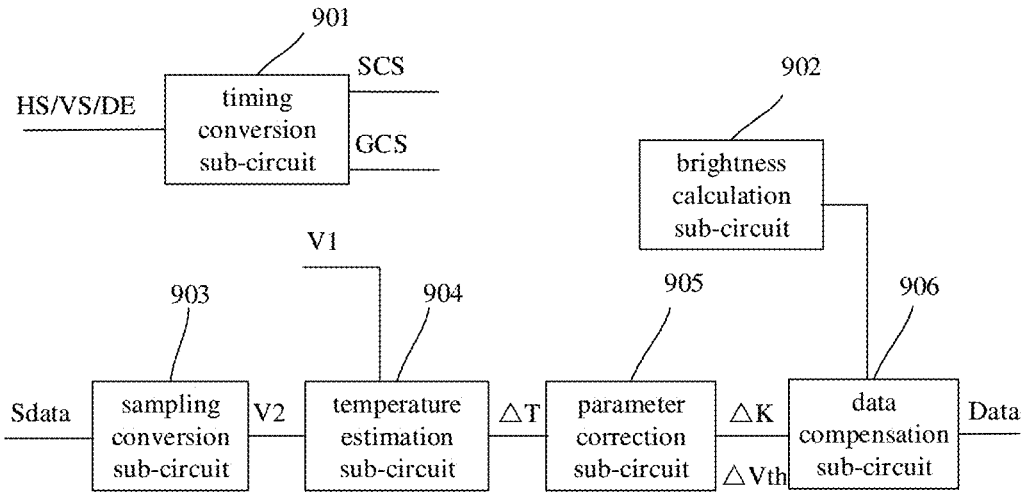
FIG. 9 is a schematic structural diagram of a timing controller in some embodiments of the present disclosure.

In some embodiments of the present disclosure, the timing controller 202 of the display panel shown in FIG. 2 may further include a timing conversion sub-circuit 901, a brightness calculation sub-circuit 902, a sampling conversion sub-circuit 903, a temperature estimation sub-circuit 904, a parameter correction sub-circuit 905 and a data compensation sub-circuit 906, as shown in FIG. 9.

The timing conversion sub-circuit 901 receives the externally inputted timing control signal HS/VS/DE, and outputs the source control signal SCS for controlling the source driver and the gate control signal GCS for controlling the gate driver.

The brightness calculation sub-circuit 902 converts input RGB video data into a brightness signal for a subsequent brightness compensation.

The sampling conversion sub-circuit 903 converts the sampled sensing data Sdata into the V2, the temperature estimation sub-circuit 904 estimates the temperature change amount of the sub-pixel ΔT according to the V1 and V2, and the parameter correction sub-circuit 905 calculates or finds the compensation amount ΔK for the carrier mobility and the compensation amount ΔVth for the threshold voltage of the driving TFT according to the temperature change amount ΔT or by searching the external memory 203 for the pre-stored correspondence between the temperature change amount and the compensation amount for the carrier mobility and the pre-stored correspondence between the temperature change amount and the compensation amount for the threshold voltage of the driving TFT; and the data compensation sub-circuit 906 updates the K and the Vth according to the ΔK and the ΔVth, and generates corrected output video data Data according to the brightness signal.

In some embodiments of the present disclosure, the first voltage value and the second voltage value are measured, and the temperature change amount of the display panel 201 is determined according to the first voltage value and the second voltage value, the value of the compensation parameter of the display panel 201 is determined according to the temperature change amount, when the compensation is performed on the driving voltage of the display panel 201, the used value of the compensation parameter is more conform to a practical state of the display panel 700, which makes the compensation result more accurate and facilitates improving the display effect.

A display device is further provided in some embodiments of the present disclosure, including the display panel described above. The display device may be any product or component having a display function such as a television, a display, a digital photo frame, a mobile phone, a tablet computer. The display device further includes a flexible circuit board, a printed circuit board and a backplane.

The above are merely specific embodiments of the present disclosure, but a protection scope of the present disclosure is not limited thereto. Any modifications or replacements that would easily occurred to those skilled in the art, without departing from the technical scope disclosed in the disclosure, should be encompassed in the protection scope of the present disclosure. Therefore, the protection scope of the present disclosure shall be subject to the protection scope of the claims.

The invention claimed is:

1. A compensation method for a display panel, wherein the display panel comprises a plurality of sub-pixels, at least one of the plurality of sub-pixels comprises a sensing capacitor, and the method comprises:

obtaining a first voltage value of the sensing capacitor, wherein the first voltage value is a voltage value of the sensing capacitor before the display panel displays an image;

obtaining a second voltage value of the sensing capacitor, wherein the second voltage value is a voltage value of the sensing capacitor when the display panel is in a display blank period;

obtaining a temperature change amount of a sub-pixel corresponding to the sensing capacitor according to the first voltage value and the second voltage value of the sensing capacitor;

determining a value of a compensation parameter of the sub-pixel according to the temperature change amount of the sub-pixel and a preset correspondence between the temperature change amount of the sub-pixel and the compensation parameter; and performing a compensation on a driving voltage of the sub-pixel according to the value of the compensation parameter as determined, wherein the obtaining the second voltage value of the sensing capacitor comprises:

charging the sensing capacitor of the sub-pixel with a second current value for a preset duration in the display blank period between two adjacent frames of display images; and calculating the second voltage value of the sensing capacitor of the sub-pixel according to the second current value of the sub-pixel and the preset duration, wherein the second current value is a current value corresponding to a current driving voltage of the sub-pixel, and the preset duration is smaller than a refresh period of the display panel.

2. The compensation method for the display panel according to claim 1, wherein the obtaining the first voltage value of the sensing capacitor comprises:

charging the sensing capacitor of the sub-pixel with a first current value for a preset duration before the display panel displays the image; and calculating the first voltage value of the sensing capacitor according to the first current value and the preset duration, wherein the first current value is a current value corresponding to an initially compensated driving voltage of the sub-pixel, and the preset duration is a predetermined value.

3. The compensation method for the display panel according to claim 1, wherein the compensation parameter comprises a carrier mobility and a threshold voltage of a driving thin film transistor (TFT).

4. The compensation method for the display panel according to claim 3, wherein the determining the value of the compensation parameter of the sub-pixel according to the temperature change amount of the sub-pixel and the preset correspondence between the temperature change amount of the sub-pixel and the compensation parameter comprises:

obtaining a correspondence between the temperature change amount and a compensation amount for the carrier mobility, and determining the compensation amount for the carrier mobility according to the obtained temperature change amount; and obtaining a correspondence between the temperature change amount and the threshold voltage of the driving TFT, and determining a compensation amount for the threshold voltage of the driving TFT according to the obtained temperature change amount.

5. The compensation method for the display panel according to claim 4, wherein the performing the compensation on the driving voltage of the sub-pixel according to the value of the compensation parameter as determined comprises:

compensating the driving voltage of the sub-pixel according to the compensation amount for the carrier mobility as determined and the compensation amount for the threshold voltage of the driving TFT as determined.

6. The compensation method for the display panel according to claim 1, wherein after obtaining the second voltage value of the sensing capacitor, the method further comprises:

obtaining a difference value between the first voltage value and the second voltage value;

returning to a step of obtaining the second voltage value of the sensing capacitor, in a case that the difference value between the first voltage value and the second voltage value is smaller than a preset threshold; and performing steps of obtaining the temperature change amount of the sub-pixel corresponding to the sensing capacitor according to the first voltage value and the second voltage value of the sensing capacitor, and determining the value of the compensation parameter of the sub-pixel according to the temperature change amount of the sub-pixel and the preset correspondence between the temperature change amount of the sub-pixel and the compensation parameter, in a case that the difference value between the first voltage value and the second voltage value is not smaller than the preset threshold, and returning to the step of obtaining the second voltage value of the sensing capacitor after performing the compensation on the driving voltage of the sub-pixel according to the value of the compensation parameter as determined.

7. The compensation method for the display panel according to claim 2, wherein the first current value is calculated according to the following formula:

$$I_1 = \frac{1}{2}K_1 C_{ox}\frac{W}{L}(V_{gs1} - V_{th1})^2$$

wherein $I_1$ is the first current value, $C_{ox}$ is a gate oxide capacitance of the driving TFT; W/L is a width-to-length ratio of the driving TFT; $V_{gs1}$ is the initially compensated driving voltage of the sub-pixel; $K_1$ is an initial value of a carrier mobility of the driving TFT, and $V_{th1}$ is an initial value of a threshold voltage of the driving TFT.

8. The compensation method for the display panel according to claim 7, wherein the first voltage value is calculated according to the following formula:

$$V_1 = \frac{1}{C}\int_0^T I_1 dt$$

wherein $V_1$ is the first voltage value, C is a capacitance value of the sensing capacitor, $I_1$ is the first current value, and T is the preset duration.

9. The compensation method for the display panel according to claim 1, wherein the second current value is calculated according to the following formula:

$$I_2 = \frac{1}{2}K_2 C_{ox}\frac{W}{L}(V_{gs2} - V_{th2})^2$$

wherein $I_2$ is the second current value, $C_{ox}$ is a gate oxide capacitance of the driving TFT; W/L is a width-to-length ratio of the driving TFT; $V_{gs2}$ is the current driving voltage of the sub-pixel; $K_2$ is a current carrier mobility of the driving TFT, and $V_{th2}$ is a current threshold voltage of the driving TFT.

10. The compensation method for the display panel according to claim 9, wherein the second voltage value is calculated according to the following formula:

$$V_2 = \frac{1}{C}\int_0^T I_2 dt$$

wherein $V_2$ is the second voltage value, C is a capacitance value of the sensing capacitor, $I_2$ is the second current value, and T is the preset duration.

11. A display panel, comprising a plurality of sub-pixels, wherein at least one of the plurality of sub-pixels comprises a sensing capacitor, and the display panel comprises:

a first obtaining circuit, configured to obtain a first voltage value of the sensing capacitor, wherein the first voltage value is a voltage value of the sensing capacitor before the display panel displays an image;

a second obtaining circuit, configured to obtain a second voltage value of the sensing capacitor, wherein the second voltage value is a voltage value of the sensing capacitor when the display panel is in a display blank period;

a temperature change amount obtaining circuit, configured to obtain a temperature change amount of a sub-pixel corresponding to the sensing capacitor according to the first voltage value and the second voltage value of the sensing capacitor;

a compensation parameter value determining circuit, configured to determine a value of a compensation parameter of the sub-pixel according to the temperature change amount of the sub-pixel and a preset correspondence between the temperature change amount of the sub-pixel and the compensation parameter; and a compensation circuit, configured to perform a compensation on a driving voltage of the sub-pixel according to the value of the compensation parameter as determined, wherein the second obtaining circuit is configured to:

charge the sensing capacitor of the sub-pixel with a second current value for a preset duration in the display blank period between two adjacent frames of display images; and calculate the second voltage value of the sensing capacitor of the sub-pixel according to the second current value of the sub-pixel and the preset duration, the preset duration being smaller than a refresh period of the display panel.

12. The display panel according to claim 11, wherein the first obtaining circuit is configured to:

charge the sensing capacitor of the sub-pixel with a first current value for a preset duration before the display panel displays the image; and calculate the first voltage value of the sensing capacitor according to the first current value and the preset duration, wherein the first current value is a current value corresponding to an initially compensated driving voltage of the sub-pixel, and the preset duration is a predetermined value.

13. The display panel according to claim 11, wherein the compensation parameter comprises a carrier mobility and a threshold voltage of a driving thin film transistor (TFT), and the compensation parameter value determining circuit comprises a carrier mobility determining sub-circuit and a threshold voltage determining sub-circuit;

the carrier mobility determining sub-circuit is configured to obtain a correspondence between the temperature change amount and a compensation amount for the carrier mobility, and determine the compensation amount for the carrier mobility according to the obtained temperature change amount; and the threshold voltage determining sub-circuit is configured to obtain a correspondence between the temperature change amount and the threshold voltage of the driving TFT, and determine a compensation amount for the threshold voltage of the driving TFT according to the obtained temperature change amount.

14. The display panel according to claim 13, wherein the compensation circuit is configured to perform the compensation on the driving voltage of the sub-pixel according to the compensation amount for the carrier mobility as determined and the compensation amount for the threshold voltage of the driving TFT as determined.

15. The display panel according to claim 11, further comprising a third obtaining circuit, wherein the third obtaining circuit is configured to obtain a difference value between the first voltage value and the second voltage value;

in a case that the difference value between the first voltage value and the second voltage value is smaller than a preset threshold, the second obtaining circuit obtains the second voltage value of the sensing capacitor; and in a case that the difference value between the first voltage value and the second voltage value is not smaller than the preset threshold, the temperature change amount obtaining circuit obtains the temperature change amount of the sub-pixel corresponding to the sensing capacitor according to the first voltage value and the second voltage value of the sensing capacitor, the compensation parameter value determining circuit determines the value of the compensation parameter of the sub-pixel according to the temperature change amount of the sub-pixel and the preset correspondence between the temperature change amount of the sub-pixel and the compensation parameter, and the second obtaining circuit obtains the second voltage value of the sensing capacitor after the compensation circuit performs the compensation on the driving voltage of the sub-pixel according to the value of the compensation parameter as determined.

16. A display device, comprising the display panel according to claim 11.

17. A compensation method for a display panel, wherein the display panel comprises a plurality of sub-pixels, at least one of the plurality of sub-pixels comprises a sensing capacitor, and the method comprises:

obtaining a first voltage value of the sensing capacitor, wherein the first voltage value is a voltage value of the sensing capacitor before the display panel displays an image;

obtaining a second voltage value of the sensing capacitor, wherein the second voltage value is a voltage value of the sensing capacitor when the display panel is in a display blank period;

obtaining a temperature change amount of a sub-pixel corresponding to the sensing capacitor according to the first voltage value and the second voltage value of the sensing capacitor;

determining a value of a compensation parameter of the sub-pixel according to the temperature change amount of the sub-pixel and a preset correspondence between the temperature change amount of the sub-pixel and the compensation parameter; and performing a compensation on a driving voltage of the sub-pixel according to the value of the compensation parameter as determined, wherein after obtaining the second voltage value of the sensing capacitor, the method further comprises:

obtaining a difference value between the first voltage value and the second voltage value;

returning to a step of obtaining the second voltage value of the sensing capacitor, in a case that the difference value between the first voltage value and the second voltage value is smaller than a preset threshold; and performing steps of obtaining the temperature change amount of the sub-pixel corresponding to the sensing capacitor according to the first voltage value and the second voltage value of the sensing capacitor, and determining the value of the compensation parameter of the sub-pixel according to the temperature change amount of the sub-pixel and the preset correspondence between the temperature change amount of the sub-pixel and the compensation parameter, in a case that the difference value between the first voltage value and the second voltage value is not smaller than the preset threshold, and returning to the step of obtaining the second voltage value of the sensing capacitor after performing the compensation on the driving voltage of the sub-pixel according to the value of the compensation parameter as determined.

18. The compensation method for the display panel according to claim 17, wherein the obtaining the first voltage value of the sensing capacitor comprises:

charging the sensing capacitor of the sub-pixel with a first current value for a preset duration before the display panel displays the image; and calculating the first voltage value of the sensing capacitor according to the first current value and the preset duration, wherein the first current value is a current value corresponding to an initially compensated driving voltage of the sub-pixel, and the preset duration is a predetermined value.

19. The compensation method for the display panel according to claim 17, wherein the compensation parameter comprises a carrier mobility and a threshold voltage of a driving thin film transistor (TFT).

20. The compensation method for the display panel according to claim 19, wherein the determining the value of the compensation parameter of the sub-pixel according to the temperature change amount of the sub-pixel and the preset correspondence between the temperature change amount of the sub-pixel and the compensation parameter comprises:

obtaining a correspondence between the temperature change amount and a compensation amount for the carrier mobility, and determining the compensation amount for the carrier mobility according to the obtained temperature change amount; and obtaining a correspondence between the temperature change amount and the threshold voltage of the driving TFT, and determining a compensation amount for the threshold voltage of the driving TFT according to the obtained temperature change amount.

* * * * *